US011619097B2

(12) United States Patent
Batarseh et al.

(10) Patent No.: US 11,619,097 B2
(45) Date of Patent: Apr. 4, 2023

(54) SYSTEM AND METHOD FOR LASER DOWNHOLE EXTENDED SENSING

(71) Applicant: Saudi Arabian Oil Company, Dhahran (SA)

(72) Inventors: Sameeh Issa Batarseh, Dhahran (SA); Damian Pablo San Roman Alerigi, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/328,564

(22) Filed: May 24, 2021

(65) Prior Publication Data

US 2022/0372822 A1 Nov. 24, 2022

(51) Int. Cl.
*E21B 7/15* (2006.01)
*E21B 47/135* (2012.01)

(52) U.S. Cl.
CPC ..... *E21B 7/15* (2013.01); *E21B 47/135* (2020.05)

(58) Field of Classification Search
CPC . E21B 7/14; E21B 7/15; E21B 47/135; E21B 29/02
See application file for complete search history.

(56) References Cited

U.S. PATENT DOCUMENTS 2,757,738 A 9/1948 Ritchey
2,795,279 A 6/1957 Erich
2,799,641 A 7/1957 Gordon
3,016,244 A 1/1962 Friedrich et al.
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
(Continued)

FOREIGN PATENT DOCUMENTS

CA 2669721 7/2011
CN 101079591 11/2007
(Continued)

OTHER PUBLICATIONS

U.S. Appl. No. 17/064,459, filed Oct. 6, 2020, Alelaiwy et al.
(Continued)

*Primary Examiner* — Kristyn A Hall
(74) *Attorney, Agent, or Firm* — Fish & Richardson P.C.

(57) ABSTRACT

Some implementations of the present disclosure provide a laser drilling tool assembly comprising: (i) a body that includes: a first segment configured to receive an input beam from a laser source and couple the input beam to provide an irradiation beam to irradiate a downhole target, and a second segment housing one or more purging pipes; and (ii) a tool head that includes: a retractable nozzle; and one or more optical sensing elements mounted on the retractable nozzle, wherein when the downhole target is being irradiated by the irradiation beam, the retractable nozzle is extended towards the downhole target such that the one or more optical sensing elements are positioned closer to the downhole target.

18 Claims, 8 Drawing Sheets

(56) References Cited

U.S. PATENT DOCUMENTS 3,428,125 A 2/1969 Parker
3,522,848 A 8/1970 New
3,547,192 A 12/1970 Claridge et al.
3,547,193 A 12/1970 Gill
3,642,066 A 2/1972 Gill
3,696,866 A 10/1972 Dryden
3,735,336 A 5/1973 Long
3,862,662 A 1/1975 Kern
3,874,450 A 4/1975 Kern
3,931,856 A 1/1976 Barnes
3,946,809 A 3/1976 Hagedorn
3,948,319 A 4/1976 Pritchett
4,008,762 A 2/1977 Fisher et al.
4,010,799 A 3/1977 Kern et al.
4,019,575 A 4/1977 Pisio
4,084,637 A 4/1978 Todd
4,135,579 A 1/1979 Rowland et al.
4,140,179 A 2/1979 Kasevich et al.
4,140,180 A 2/1979 Bridges et al.
4,144,935 A 3/1979 Bridges et al.
4,185,691 A 1/1980 Tubin et al.
4,193,448 A 3/1980 Jearnbey
4,193,451 A 3/1980 Dauphine
4,196,329 A 4/1980 Rowland et al.
4,199,025 A 4/1980 Carpenter
4,227,582 A 10/1980 Price
4,265,307 A 5/1981 Elkins
RE30,738 E 9/1981 Bridges et al.
4,301,865 A 11/1981 Kasevich et al.
4,320,801 A 3/1982 Rowland et al.
4,373,581 A 2/1983 Toellner
4,396,062 A 8/1983 Iskander
4,412,585 A 11/1983 Bouck
4,437,519 A 3/1984 Cha
4,449,585 A 5/1984 Bridges et al.
4,457,365 A 7/1984 Kasevich et al.
4,462,699 A 7/1984 Herbert et al.
4,470,459 A 9/1984 Copland
4,476,926 A 10/1984 Bridges et al.
4,484,627 A 11/1984 Perkins
4,485,868 A 12/1984 Sresty et al.
4,485,869 A 12/1984 Sresty et al.
4,487,257 A 12/1984 Dauphine
4,495,990 A 1/1985 Titus et al.
4,498,535 A 2/1985 Bridges
4,499,948 A 2/1985 Perkins
4,508,168 A 4/1985 Heeren
4,513,815 A 4/1985 Rundell et al.
4,524,826 A 6/1985 Savage
4,524,827 A 6/1985 Bridges et al.
4,545,435 A 10/1985 Bridges et al.
4,553,592 A 11/1985 Looney et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,660,636 A 4/1987 Rundell et al.
4,701,015 A 10/1987 Saito
4,705,108 A 11/1987 Little et al.
4,717,253 A 1/1988 Pratt
4,756,627 A 7/1988 Nelson
4,817,711 A 4/1989 Jearnbey
4,819,723 A 4/1989 Whitfill
4,853,507 A 8/1989 Samardzija
5,013,126 A 5/1991 Hattori
5,039,192 A 8/1991 Basu
5,055,180 A 10/1991 Klaila
5,068,819 A 11/1991 Misra et al.
5,072,087 A 12/1991 Apte
5,082,054 A 1/1992 Kiamanesh
5,236,039 A 8/1993 Edelstein et al.
5,367,157 A 11/1994 Nilsson
5,623,576 A 4/1997 Deans
5,899,274 A 5/1999 Frauenfeld et al.
6,041,860 A 3/2000 Nazzal et al.
6,056,882 A 5/2000 Scalliet
6,077,400 A 6/2000 Kartchner
6,189,611 B1 2/2001 Kasevich
6,214,236 B1 4/2001 Scalliet
6,285,014 B1 9/2001 Beck et al.
6,332,500 B1 12/2001 Ellefsen
6,387,327 B1 5/2002 Ricci
6,405,802 B1 6/2002 Williams
6,413,399 B1 7/2002 Kasevich
6,544,411 B2 4/2003 Varandaraj
6,597,446 B2 7/2003 Klooster et al.
6,678,616 B1 1/2004 Winkler et al.
6,755,262 B2 6/2004 Parker
6,814,141 B2 11/2004 Huh et al.
6,888,097 B2 5/2005 Batarseh
6,932,155 B2 8/2005 Vinegar
7,024,081 B2 4/2006 Dowd
7,048,051 B2 5/2006 McQueen
7,091,460 B2 8/2006 Kinzer
7,109,457 B2 9/2006 Kinzer
7,115,847 B2 10/2006 Kinzer
7,131,498 B2 11/2006 Campo et al.
7,147,064 B2 12/2006 Batarseh et al.
7,312,428 B2 12/2007 Kinzer
7,331,385 B2 2/2008 Symington
7,445,041 B2 11/2008 O'Brien
7,461,693 B2 12/2008 Considine et al.
7,484,561 B2 2/2009 Bridges
7,486,248 B2 2/2009 Halek et al.
7,562,708 B2 7/2009 Cogliandro et al.
7,629,497 B2 12/2009 Pringle
7,631,691 B2 12/2009 Symington et al.
7,668,419 B2 2/2010 Taverner
7,677,673 B2 3/2010 Tranquilla et al.
7,719,676 B2 5/2010 DiFoggio
7,775,961 B2 8/2010 Meikrantz
7,828,057 B2 11/2010 Kearl et al.
7,891,416 B2 2/2011 Pankratz et al.
7,909,096 B2 3/2011 Clark et al.
8,096,349 B2 1/2012 Considine et al.
8,210,256 B2 7/2012 Bridges et al.
8,378,275 B2 2/2013 Novak
8,431,015 B2 4/2013 Banerjee
8,485,254 B2 7/2013 Huber et al.
8,526,171 B2 9/2013 Wu et al.
8,555,969 B2 10/2013 Goodwin et al.
8,586,898 B2 11/2013 Novak
8,678,087 B2 3/2014 Schultz et al.
8,824,240 B2 9/2014 Roberts et al.
8,826,973 B2 9/2014 Moxley et al.
8,925,627 B2 1/2015 Tupper et al.
8,960,215 B2 2/2015 Cui et al.
9,075,155 B2 7/2015 Luscombe et al.
9,080,949 B2 7/2015 Mestayer et al.
9,217,291 B2 12/2015 Batarseh
9,255,836 B2 2/2016 Taverner et al.
9,322,255 B2 4/2016 Diehl et al.
9,353,612 B2 5/2016 Batarseh
9,528,364 B2 12/2016 Samuel et al.
9,546,548 B2 1/2017 Hartog
9,567,819 B2 2/2017 Cavender et al.
9,584,711 B2 2/2017 Tjhang et al.
9,644,464 B2 5/2017 Batarseh
9,690,376 B2 6/2017 Davis et al.
9,765,609 B2 9/2017 Chemali et al.
10,012,758 B2 7/2018 Speck et al.
10,163,213 B2 12/2018 Boyle et al.
10,330,915 B2 6/2019 Rudolf et al.
10,641,079 B2 5/2020 Aljubran et al.
10,941,644 B2 3/2021 Aljubran et al.
2003/0075339 A1 4/2003 Gano
2003/0098605 A1 5/2003 Vinegar
2003/0173072 A1 9/2003 Vinegar
2004/0256103 A1 12/2004 Batarseh
2005/0199386 A1 9/2005 Kinzer
2005/0207938 A1 9/2005 Hanawa
2006/0012785 A1 1/2006 Funk et al.
2006/0076347 A1 4/2006 Kinzer

(56) References Cited

U.S. PATENT DOCUMENTS

| | | | |
|---|---|---|---|
| 2006/0102343 | A1 | 5/2006 | Skinner et al. |
| 2006/0102625 | A1 | 5/2006 | Kinzer |
| 2006/0106541 | A1 | 5/2006 | Hassan et al. |
| 2006/0231257 | A1 | 10/2006 | Reed et al. |
| 2007/0000662 | A1 | 1/2007 | Symington et al. |
| 2007/0108202 | A1 | 5/2007 | Kinzer |
| 2007/0131591 | A1 | 6/2007 | Pringle |
| 2007/0131594 | A1 | 6/2007 | Hakola |
| 2007/0137852 | A1 | 6/2007 | Considine et al. |
| 2007/0137858 | A1 | 6/2007 | Considine et al. |
| 2007/0153626 | A1 | 7/2007 | Hayes et al. |
| 2007/0181301 | A1 | 8/2007 | O'Brien |
| 2007/0187089 | A1 | 8/2007 | Bridges |
| 2007/0193744 | A1 | 8/2007 | Bridges |
| 2007/0204994 | A1 | 9/2007 | Wimmersperg |
| 2007/0261844 | A1 | 11/2007 | Cogliandro et al. |
| 2007/0267191 | A1 | 11/2007 | Pfeiffer |
| 2007/0284107 | A1 | 12/2007 | Crichlow |
| 2007/0289736 | A1 | 12/2007 | Kearl et al. |
| 2008/0073079 | A1 | 3/2008 | Tranquilla et al. |
| 2008/0111064 | A1 | 5/2008 | Andrews et al. |
| 2008/0173443 | A1 | 7/2008 | Symington et al. |
| 2009/0008079 | A1 | 1/2009 | Zazovsky |
| 2009/0071646 | A1 | 3/2009 | Pankratz et al. |
| 2009/0209825 | A1 | 8/2009 | Efinger et al. |
| 2009/0252842 | A1 | 10/2009 | Wang |
| 2009/0259446 | A1 | 10/2009 | Zhang et al. |
| 2009/0288820 | A1 | 11/2009 | Barron et al. |
| 2009/0296778 | A1 | 12/2009 | Kinugasa et al. |
| 2010/0044103 | A1 | 2/2010 | Moxley et al. |
| 2010/0089584 | A1 | 4/2010 | Burns |
| 2010/0095742 | A1 | 4/2010 | Symington et al. |
| 2010/0186955 | A1 | 7/2010 | Saasen et al. |
| 2010/0296100 | A1 | 11/2010 | Blacklaw |
| 2011/0011576 | A1 | 1/2011 | Cavender et al. |
| 2012/0000642 | A1 | 1/2012 | Betzer Tsilevich |
| 2012/0012319 | A1 | 1/2012 | Dennis |
| 2012/0048118 | A1 | 3/2012 | Hess |
| 2012/0074110 | A1 | 3/2012 | Zediker et al. |
| 2012/0075615 | A1 | 3/2012 | Niclass et al. |
| 2012/0169841 | A1 | 6/2012 | Chemali et al. |
| 2012/0181020 | A1 | 7/2012 | Barron et al. |
| 2012/0312538 | A1 | 12/2012 | Koolman |
| 2013/0008653 | A1 | 1/2013 | Schultz et al. |
| 2013/0037268 | A1* | 2/2013 | Kleefisch ..... E21B 43/11 166/55.1 |
| 2013/0126164 | A1 | 5/2013 | Sweatman et al. |
| 2013/0191029 | A1 | 7/2013 | Heck, Sr. |
| 2013/0213637 | A1 | 8/2013 | Kearl |
| 2013/0213795 | A1 | 8/2013 | Strohm et al. |
| 2013/0255936 | A1 | 10/2013 | Statoilydro et al. |
| 2014/0034144 | A1 | 2/2014 | Cui et al. |
| 2014/0050619 | A1 | 2/2014 | Meller |
| 2014/0090846 | A1 | 4/2014 | Deutch |
| 2014/0110118 | A1 | 4/2014 | Hocking |
| 2014/0199017 | A1 | 7/2014 | Den Boer et al. |
| 2014/0231147 | A1 | 8/2014 | Bozso et al. |
| 2014/0231398 | A1 | 8/2014 | Land et al. |
| 2014/0240951 | A1 | 8/2014 | Brady et al. |
| 2014/0278111 | A1 | 9/2014 | Gerrie et al. |
| 2014/0360778 | A1 | 12/2014 | Batarseh |
| 2015/0129203 | A1 | 5/2015 | Deutch et al. |
| 2015/0275636 | A1 | 10/2015 | Diehl et al. |
| 2015/0308248 | A1 | 10/2015 | Diehl et al. |
| 2015/0355015 | A1 | 12/2015 | Crickmore et al. |
| 2016/0153240 | A1 | 6/2016 | Braga et al. |
| 2016/0223389 | A1 | 8/2016 | Farhadiroushan et al. |
| 2016/0247316 | A1 | 8/2016 | Whalley et al. |
| 2017/0044889 | A1 | 2/2017 | Rudolf et al. |
| 2017/0097305 | A1 | 4/2017 | Prinz |
| 2017/0191314 | A1 | 7/2017 | Faircloth et al. |
| 2017/0234104 | A1 | 8/2017 | James |
| 2017/0260847 | A1 | 9/2017 | Xia et al. |
| 2018/0010419 | A1 | 1/2018 | Livescu et al. |
| 2018/0156600 | A1 | 6/2018 | Cable et al. |
| 2018/0266226 | A1 | 9/2018 | Batarseh et al. |
| 2020/0024926 | A1 | 1/2020 | Reinas et al. |
| 2020/0048966 | A1 | 2/2020 | Batarseh |
| 2020/0115962 | A1* | 4/2020 | Batarseh ..... E21B 17/1078 |
| 2020/0134773 | A1 | 4/2020 | Pinter et al. |
| 2020/0319108 | A1 | 10/2020 | Butte et al. |
| 2020/0392793 | A1 | 12/2020 | Batarseh |
| 2020/0392794 | A1 | 12/2020 | Al Obaid et al. |
| 2020/0392824 | A1 | 12/2020 | Batarseh et al. |
| 2021/0054721 | A1 | 2/2021 | Batarseh |
| 2021/0156243 | A1 | 5/2021 | Aljubran et al. |

FOREIGN PATENT DOCUMENTS

| | | |
|---|---|---|
| CN | 102493813 | 6/2012 |
| CN | 203081295 | 7/2013 |
| CN | 203334954 | 12/2013 |
| CN | 103591927 | 2/2014 |
| CN | 104295448 | 1/2015 |
| CN | 204627586 | 9/2015 |
| CN | 107462222 | 12/2017 |
| CN | 110847970 | 2/2020 |
| EP | 2317068 | 5/2011 |
| EP | 2737173 | 6/2014 |
| GB | 2230109 | 10/1990 |
| WO | WO 2008146017 | 12/2008 |
| WO | WO 2009020889 | 2/2009 |
| WO | WO 2011038170 | 3/2011 |
| WO | WO 2011101739 | 8/2011 |
| WO | WO 2012038814 | 3/2012 |
| WO | WO 2012136951 | 10/2012 |
| WO | WO 2013023020 | 2/2013 |
| WO | WO 2013155061 | 10/2013 |
| WO | WO 2014171960 | 10/2014 |
| WO | WO 2014189533 | 11/2014 |
| WO | WO 2014201313 | 12/2014 |
| WO | WO 2016069977 | 5/2015 |
| WO | WO 2015095155 | 6/2015 |
| WO | WO 2015140636 | 9/2015 |
| WO | WO 2015142330 | 9/2015 |
| WO | WO 2016148687 | 9/2016 |
| WO | WO 2017011078 | 1/2017 |
| WO | WO 2018169991 | 9/2018 |
| WO | WO 2018222541 | 12/2018 |
| WO | WO 2019023537 | 1/2019 |

OTHER PUBLICATIONS

Al-Nakhli et al., "Enhanced Oil Recovery by In-Situ Steam Generation," U.S. Appl. No. 61/652,359, filed Jun. 7, 2010, 25 pages.

Antony et al., "Photonics and fracture toughness of heterogeneous composite materials," 2017, Scientific Reports, 7:4539, 8 pages.

Batarseh et al., "Downhole high-power laser tools development and evolutions," presented at the Abu Dhabi International Petroleum & Exhibition Conference, Abu Dhabi, United Arab Emirates, Nov. 12-15, 2018, 15 pages.

Batarseh et al., "High power laser application in openhole multiple fracturing with an overview of laser research; Past, present and future," presented at the SPE Saudi Arabia Section Technical Symposium and Exhibition, Khobar, Saudi Arabia, Apr. 8-11, 2012, Society of Petroleum Engineers, 10 pages.

Batarseh et al., "Laser Gun: The Next Perforation Technology," presented at the SPE Middle East Oil & Gas Show and Conference, Manama, Bahrain, Mar. 18-21, 2019, 15 pages.

Batarseh et al., "Microwave With Assisted Ceramic Materials to Maximize Heat Penetration and Improve Recovery Efficiency of Heavy Oil Reservoirs," presented at the SPE Middle East Oil & Gas Show and Conference, Kingdom of Bahrain, Mar. 6-9, 2017, 24 pages.

Batarseh et al., "Well Perforation Using High-Power Lasers," presented at the SPE Annual Technical Conference and Exhibition, Denver, Colorado, Oct. 5-8, 2003, 10 pages.

Berkowitz et al., "Extraction of Oil Sand Bitmens with Supercritical Water"; Fuel Processing Technology, 25: 1 (33-44), Apr. 1, 1990, 12 pages.

(56) References Cited

OTHER PUBLICATIONS

Bientinesi et al., "A New Technique for Heavy Oil Recovery Based on Electromagnetic Heating: Pilot Scale Experimental Validation"; Chemical Engineering Transactions, 32 (2287-2292), Jun. 2, 2013, 6 pages.
Boinott et al., "High resolution geomechanical profiling in heterogeneous source rock from the Vaca Muerta Formation, Neuquén Basin, Argentina," presented at the 52nd US Rock Mechanics/Geomechanics Symposium, Seattle, Washington, USA, American Rock Mechanics Association, Jun. 17-20, 2018, 8 pages.
Born et al., "Principles of Optics: Electromagnetic Theory of Propagation, Interference and Diffraction of Light," 6th ed. Pergamon Press, 808 pages.
Caryotakis, "The klystron: A microwave source of surprising range and endurance." The American Physical Society, Division of Plasma Physics Conference in Pittsburg, PA, Nov. 1997, 14 pages.
Cerutti et al.; "A New Technique for Heavy Oil Recovery Based on Electromagnetic Heating: System Design and Numerical Modelling"; Chemical Engineering Transaction, 32:1255-1260, Dec. 31, 2013, 6 pages.
Frank, "Discriminating between coherent and incoherent might with metasurfaces," Jul. 2018, 11 pages.
Gemmeke and Ruiter, "3D ultrasound computer tomography for medical imagining," Nuclear Instruments and Methods in Physics Research A 580, Oct. 1, 2007, 9 pages.
Ghatak and Thyagarajan, "An introduction to Fiber Optics," Cambridge University Press, 1st Ed., Jun. 28, 1998, 6 pages.
Graves et al., "Temperatures Induced by High Power Lasers: Effects on Reservoir Rock Strength and Mechanical Properties," presented at the SPE/ISRM Rock Mechanics Conference, Irvine, Texas, Oct. 20-23, 2002, 7 pages.
Guo et al., "Convolutional Neural Networks for Steady Flow Approximation," presented at the 22nd ACM SIGKDD International Conference on Knowledge Discovery and Data Mining—KDD, San Francisco, California, Aug. 13-17, 2016, 10 pages.
Hveding et al., "Integrated Applications of Fiber-Optic Distributed Acoustic and Temperature Sensing," SPE Latin American and Caribbean Petroleum Engineering Conference, Nov. 20, 2015, 16 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
Li et al., "Application of carbon nanocatalysts in upgrading heavy crude oil assisted with microwave heating," Nano letters, 2014, 14.6: 3002-3008, 7 pages.
Mutyala et al., "Microwave applications to oil sands and petroleum: A review," Fuel Processing Technology, 2010, 91:127-135, 9 pages.
Nourbakhsh et al., "Embedded sensors and feedback loops for iterative improvement in design synthesis for additive manufacturing," presented at the ASME 2016 International Design Engineering Technical Conference and Information in Engineering Conference, Charlotte, NC, 9 pages.
O-brien et al. et al., "StarWars Laser Technology for Gas Drilling and Completions in the 21st Century," presented at the SPE Annual Technical Conference and Exhibition, Houston, Texas, Oct. 3-6, 1999, 10 pages.
Ruiter et al., "3D ultrasound computer tomography of the breast: A new era?" European Journal of Radiology 81S1, Sep. 2012, 2 pages.
Salehi et al., "Laser drilling—drilling with the power of light," Gas Technology Institute Report, 2000-2007 period report, Chicago, IL, 318 pages.
San-Roman-Alerigi et al., "Machine learning and the analysis of high-power electromagnetic interaction with subsurface matter," presented at the SPE Middle East Oil and Gas Show and Conference, Manama, Bahrain, Mar. 18-21, 2019, 11 pages.
San-Roman-Alerigi et al., "Geomechanical and thermal dynamics of distributed and far-field dielectric heating of rocks assisted by nano-enablers—A numerical exploration," presented at the SPE Abu Dhabi International Petroleum Exhibition and Conference, Abu Dhabi, UAE, Nov. 13-16, 2017, 21 pages.
San-Roman-Alerigi et al., "Numerical Modeling of Thermal and Mechanical Effects in Laser-Rock Interaction—An Overview," presented at the 50th U.S. Rock Mechanics/Geomechanics Symposium, Houston, TX, Jun. 26-29, 2016; American Rock Mechanics Association, 2016, 11 pages.
towarddatascience.com [online], "Support vector machine—introduction to machine learning algorithms," Ghandi, Jul. 7, 2018, retrieved May 19, 2021, retrieved from URL <https://towardsdatascience.com/support-vector-machine-introduction-to-machine-learning-algorithms-934a444fca47>, 12 pages.
towardsdatascience.com [online], "K-Means Clustering—Explained," Yildrim, Mar. 2020, retrieved on May 19, 2021, retrieved from URL <https://towardsdatascience.com/k-means-clustering-explained-4528df86a120#:~:text=K%2Dmeans%20clustering%20aims%20to,methods%20to%20measure%20the%20distance>, 12 pages.
Vaferi et al., "Modeling and analysis of effective thermal conductivity of sandstone at high pressure and temperature using optimal artificial neural networks," Journal of Petroleum Science and Engineering, 2014, 119, 10 pages.
Zinati, "Using Distributed Fiber-Optic Sensing Systems to Estimate Inflow and Reservoir Properties," Technische Universiteit Delft, 2014, 135 pages.
PCT International Search Report and Written Opinion in International Appln. No. PCT/US2022/072523, dated Aug. 1, 2022, 15 pages.
Batarseh et al., "Laser Perforation: The Smart Completion," SPE-197192-MS, Nov. 2019, 15 pages.

* cited by examiner

SYSTEM AND METHOD FOR LASER DOWNHOLE EXTENDED SENSING

TECHNICAL FIELD

This disclosure generally relates to rock characterization and classification during a drilling process.

BACKGROUND

Rock, in geology, refers to naturally occurring and coherent aggregate of one or more minerals. Such aggregates constitute the basic unit of which the solid Earth is composed. The aggregates typically form recognizable and mappable volumes. Characterization and classification of rocks can reveal insights about the layered formation, including fluid saturation, of the solid Earth during a drilling operation in the context of gas and oil exploration.

SUMMARY

In one aspect, some implementations provide a laser drilling tool assembly comprising: a body that includes: a first segment configured to receive an input beam from a laser source and couple the input beam to provide an irradiation beam to irradiate a downhole target, and a second segment housing one or more purging pipes; a tool head that includes: a retractable nozzle; and one or more optical sensing elements mounted on the retractable nozzle, wherein when the downhole target is being irradiated by the irradiation beam, the retractable nozzle is extended towards the downhole target such that the one or more optical sensing elements are positioned closer to the downhole target.

Implementations may include one or more of the following features.

The one or more optical sensing elements may include an optical luminosity sensor, or a spectral sensor. The optical luminosity sensor may include at least one of: a charge-coupled device (CCD) sensor, a complementary metal oxide semiconductor (CMOS) sensor, an avalanche photodiode (APD), or a photo diode (PD). The spectral sensor may include at least one of: a scanning sensor, or a Fourier-transform infrared spectroscopy (FTIR) sensor.

The one or more optical sensing element may include: coupling optical components configured to capture light signals emitted from the downhole target. The tool head may further comprises a sensing cable. The light signals may be transmitted, via the sensing cable, to an optical sensor that includes at least one of an optical luminosity sensor, or a spectral sensor. The optical sensor may be located outside the tool head.

The tool head may further include wheels in the retractable nozzle. The wheels may be configured to retract or extend the retractable nozzle. The wheels may be further configured to attach the sensing cable to the retractable nozzle.

The tool head may further include a sensor located at a tip of the tool head. The sensor may be configured to measure an ambient temperature and a range between the tip of the tool head and the downhole target when the downhole target is being irradiated by the irradiation beam.

The tool head may further include: a lens assembly to couple the irradiation beam to reach the downhole target. The tool head may further include: one or more internal purging nozzles mounted inside the lens assembly and configured to spray a flow of medium to merge with the irradiation beam. The tool head may further include: one or more external purging nozzles mounted outside the lens assembly and configured to purge debris from the downhole target being irradiated by the irradiation beam.

In another aspect, some implementations of the present disclosure provide a method that includes: lowering an laser drilling tool assembly into a wellbore shaft in which a downhole target is located; activating an irradiation beam that exits from a tool head of the laser drilling tool assembly; and extending one or more retractable nozzles on the tool head of the laser drilling tool assembly such that an optical sensing element mounted on the tool head is brought closer to the downhole target when the downhole target is being irradiated by the irradiation beam.

Implementations may include one or more of the following features.

The method may further include: collecting light signals emitting from the downhole target being irradiated by the irradiating beam. The method may further include: analyzing the light signals to characterize a rock type at the downhole target. The method may further include: retracting the one or more retractable nozzles when the light signals have been collected.

The method may further include: measuring an ambient temperature and a range between a tip of the tool head and the downhole target when the downhole target is being irradiated by the irradiation beam. The method may further include: in response to the ambient temperature exceeding a first threshold, or the range falling below a second threshold, halting an extension of the one or more retractable nozzles. The method may further include: deactivating the irradiating beam.

The method may further include: activating one or more internal purging nozzles mounted inside a lens assembly of the tool head to spray a flow of medium to merge with the irradiation beam. The method may further include: activating one or more external purging nozzles mounted outside a lens assembly of the tool head to purge debris from the downhole target being irradiated by the irradiation beam.

Implementations according to the present disclosure may be realized in computer implemented methods, hardware computing systems, and tangible computer readable media. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

The details of one or more implementations of the subject matter of this specification are set forth in the description, the claims, and the accompanying drawings. Other features, aspects, and advantages of the subject matter will become apparent from the description, the claims, and the accompanying drawings.

DESCRIPTION OF DRAWINGS

Like reference numbers and designations in the various drawings indicate like elements.

DETAILED DESCRIPTION

Figure 1:
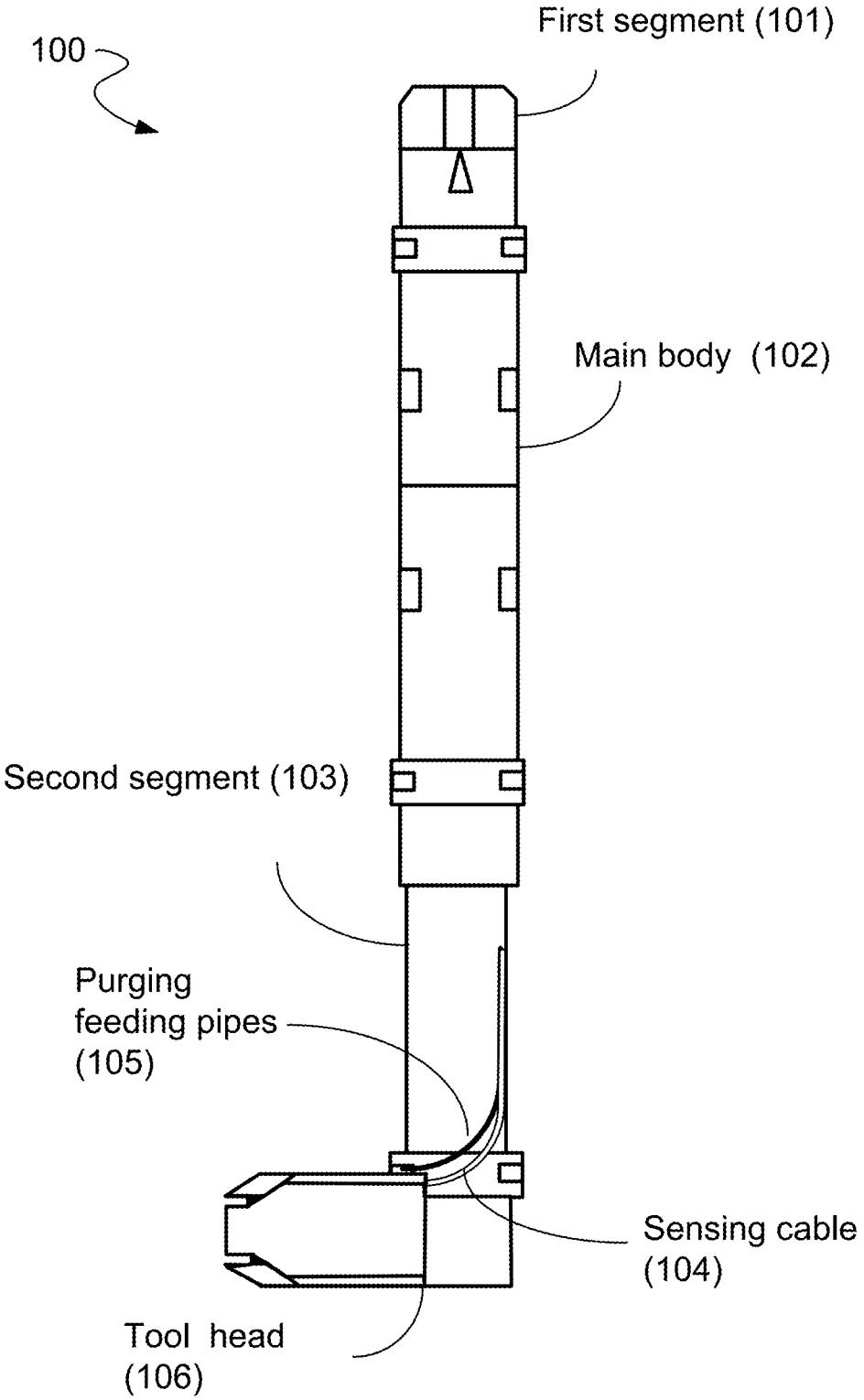
FIG. 1 illustrates a laser drilling tool configuration.

The disclosed technology is directed to a real-time and in-situ acquisition of reflectance and spectroscopic data during a laser drilling operation using high power laser (HPL). Such data may characterize the interaction of high power lasers with subsurface matter, the analysis of which may lead to classification of rock types. The interaction of high power lasers with subsurface matter is complex, intense, and fast-paced. Various characteristics of the subsurface can affect the process. Real-time sensing tools can be configured to assess the performance of laser drilling, and to characterize the target and the environment. The operation principle of the sensing tools is based on wideband spectroscopy and intensity characterization of back-scattered laser and black body radiation. Spectroscopy can identify fluids and rocks, akin to a fingerprint, and also gauge the temperature of the laser drilling process. The intensity (luminosity) analysis can reveal information about the laser drilling process and the coupling between the laser and the substrate.

The tool assembly of the implementations of the present disclosure incorporates various subsystems to analyze the light (sensor modules and edge computing). In some implementations, the tool assembly also hosts several acquisition systems to collect the light from multiple points (e.g. at different points close to and far from the interaction). In the multipoint collection configuration, light collected close to the interaction can provide information about the formation and temperature; whereas light collected at different points away from the sample would provide information about the environment due to absorption by the wellbore fluids.

The terminology used in the present disclosure includes the following terms.

The term "HPL" refers to high power laser. HPL can include pulsed or continuous wave (CW) laser or a plurality of lases with high energy. The term high power refers to lasers with peak power at or above 100 Watts. Typical HPLs for subsurface operations have peak power at or above 10 kW. HPL can be in the visible and infrared range with a wavelength, for example, from 600 nm to 10000 nm.

The term "process status" refers to a status of a laser drilling process. Examples can include glass forming, process failure/success/completion, etc.

The term "machine learning analytics" refers to the use of machine learning and applied statistics to predict unknown conditions based on the available data. Two general areas that fall under machine learning analytics are classification and regression. While classification refers to the prediction of categorical values, regression connotes the prediction of continuous numerical values. One machine learning implementation is also known as "supervised learning" where the "correct" target or y values are available. For illustration, the goal of some implementations is to learn from the available data to predict the unknown values with some defined error metrics. In supervised learning, for example, there are a set of known predictors (features) x_1, x_2, . . . , x_m which are known to the system as well as the target values y_1, y_2, . . . , y_n, which are to be inferred. The system's objective is to train a machine learning model to predict new target values y_1, y_2, . . . , y_n by observing new features.

The implementations can employ a variety of machine learning algorithms. For classification, examples of prediction algorithms can include, logistic regression, decision trees, nearest neighbor, support vector machines, K-means clustering, boosting, and neural networks. For regression, examples of predication algorithms can include least squares regression, Lasso, and others. The performance of an algorithm can depend on a number factors, such as the selected set of features, training/validation method and hyper-parameters tuning. As such, machine learning analytics can manifest as an iterative approach of knowledge finding that includes trial and error. An iterative approach can iteratively modify data preprocessing and model parameters until the result achieves the desired properties.

Referring to FIG. 1, an example of tool assembly 100 is shown for real-time assessment of laser drilling process and downhole target characterization using high power laser (HPL). An HPL laser source may have its power and spectral signature. As illustrated, the tool assembly 101 includes a first segment that includes coupling fiber optics components for receiving an input laser beam. The input laser beam can originate from a high power laser source located on the ground level. The input laser beam can propagate inside a conduit cavity that is inside the main tool body 102. In some cases, the input laser beam may also propagate along a fiber medium inside the main tool body to reach the downhole target as an irradiation beam.

In some implementations, the tool assembly 100 also includes a second segment 103 for spectroscopy and luminosity, as illustrated in FIG. 1. For example, sensors for spectroscopy and luminosity may be housed inside the second segment 103. Examples of spectral sensors include scanning and Fourier transform infrared spectroscopy (FTIR).

The tool assembly 100 may additionally sensing cable 104 extending from segment 103 into tool head 106. The sensing cable may feed light signals collected from tool head 106 to sensors housed in segment 103. In some cases, the sensing cable is connected to sensing element 107 in the head. Sensing element can collect light signals during the laser drilling process for spectroscopy and luminosity. Moreover, sensors for temperature and range measurement can also be housed in tool head to measure the distance from the tool head to the downhole target. The tool assembly 100 may additionally include purging feed pipe 105, which can eject a flow of medium to clear the path for the input laser beam to reach the downhole target as the irradiation beam. Purging feed pipe can also cool the tool head during a laser drilling process. Notably, the transmission of the HPL beam for irradiation is accomplished using special fiber optics cable capable of transmitting high energy effectively with minimum loss. In the meantime, the reflection is captured by different optic fiber, such as sensing cable 104. Because the reflection energy is relatively low, the reflection energy may not need to be handled by specialized optical cables.

While this configuration is equipped with sensors for capturing light signals for rock characterizing during a laser drilling process, the challenge is that when subsurface materials are exposed to HPL energy, the interaction will generates debris, gases and vapors. Depending on the laser power, the debris will absorb the reflected light energy and contaminate the reflected light, making it difficult, if not infeasible, for the sensor and the sensing cable to capture the light reflected, when, for example, the sensor is mounted on the tool assembly itself, that is, at a distance from the target.

Figure 2:
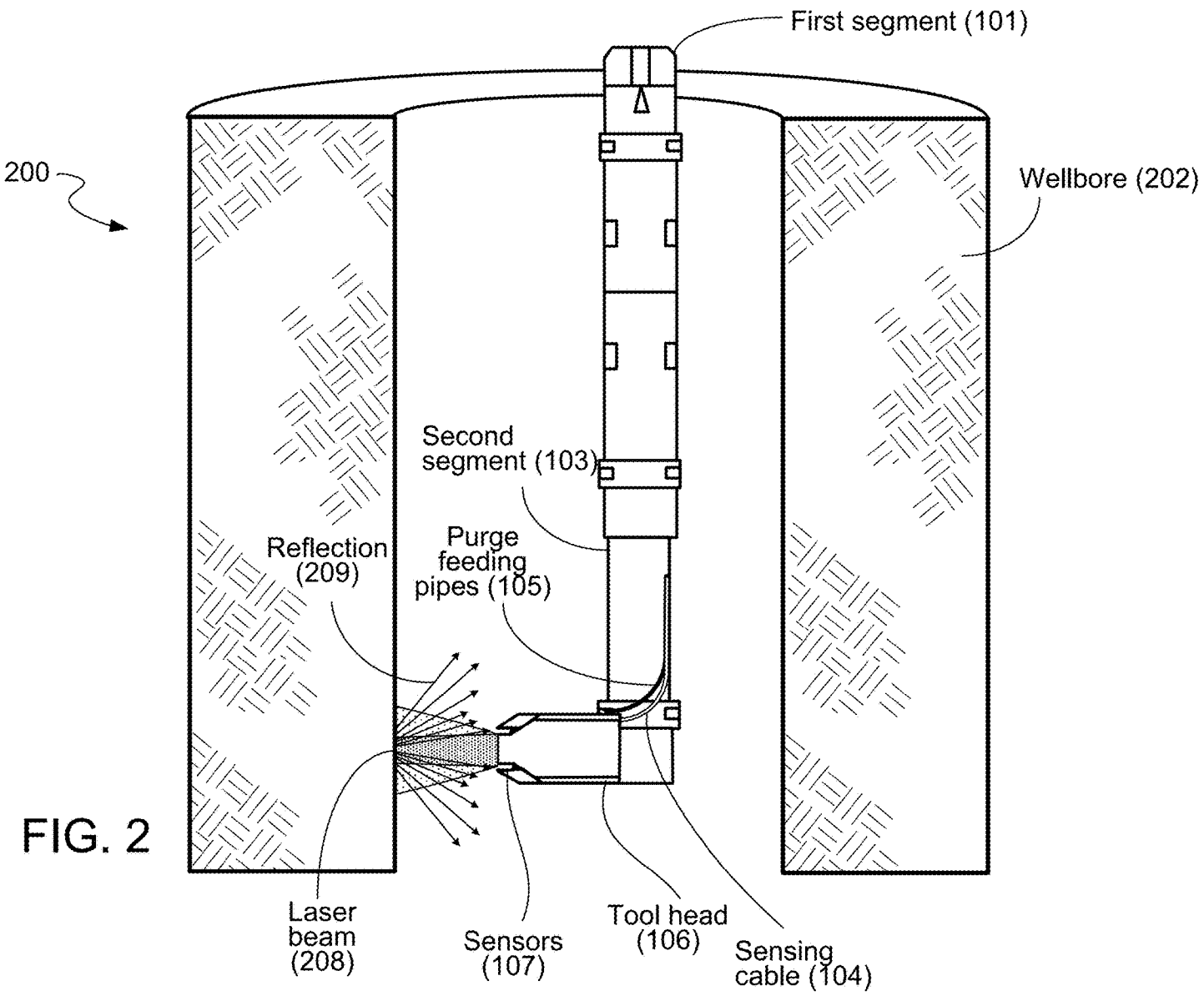
FIG. 2 is a diagram illustrating an operation of a laser drilling tool configuration.

For additional context, FIG. 2 illustrates an example 200 of operating the tool assembly 101 for irradiating a downhole target. When the tool assembly 101 is placed inside the wellbore 202 and brought to the downhole target, the laser beam 208 may be guided down the body of the tool assembly 100 to exit tool head 106. This high power laser can then interact with the subsurface materials. The laser drilling can heat up the subsurface material at extreme temperature, allowing the materials to be removed for penetrations. The reflected light 209 may propagate in all directions with debris, gases, fluid and other by-products, which can render it difficult, if not infeasible, to capture the reflected light for assessing the quality of the light interaction and characterize subsurface material based on the reflected light. For example, impurity can cause misleading or wrong interpretation of the data. Conventional and routine operations may place the laser tool so that the tool head is at distance from the downhole target.

Figure 3:
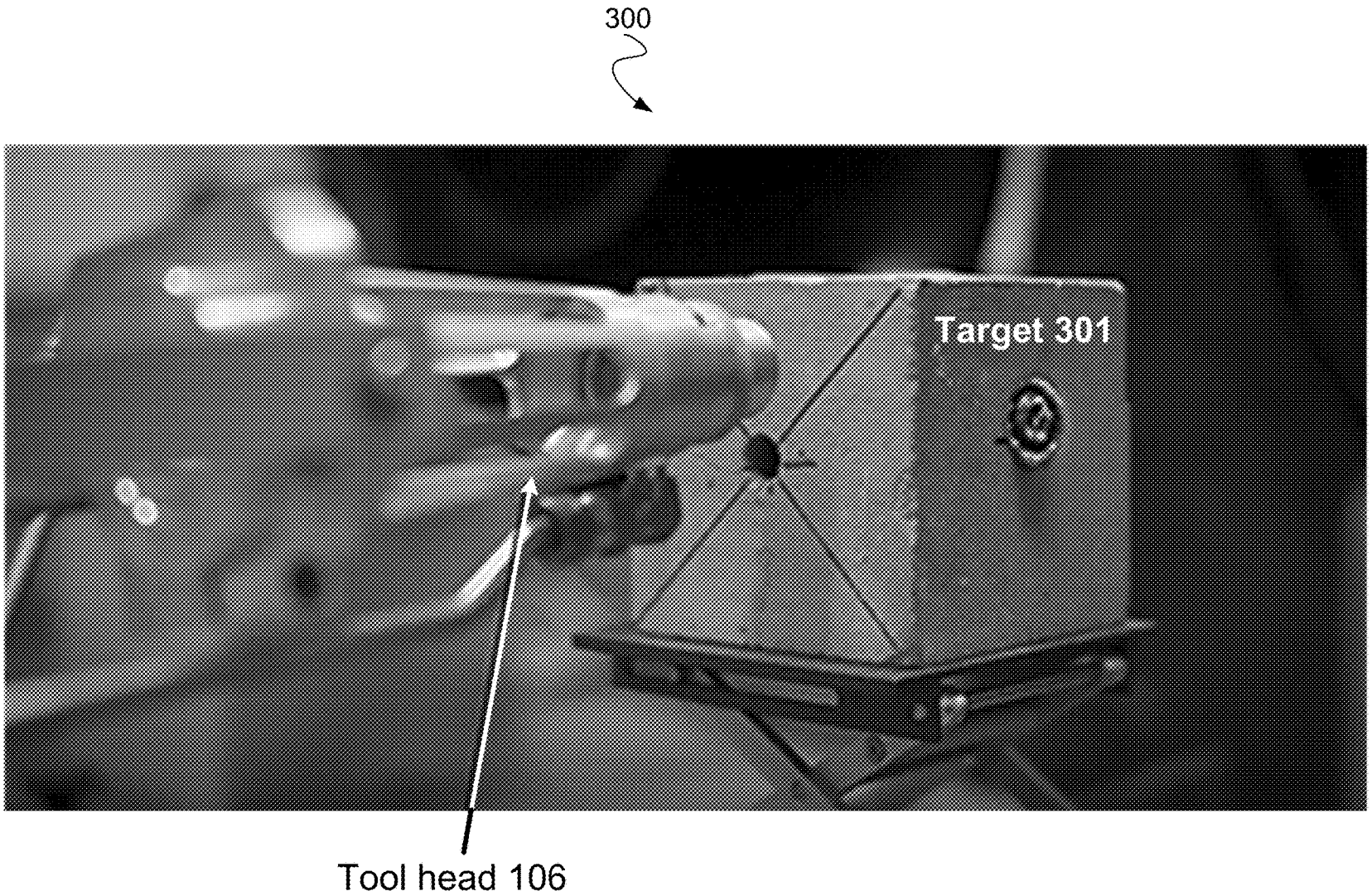
FIG. 3 shows an example of the laser drilling tool aiming at a target.

FIG. 3 shows an example 300 in which a laser drilling tool assembly is used to aim a laser beam at a target. As illustrated, a laser beam exits the tool head 106. The laser beam is aimed at a spot on target 301. As illustrated, the tool head 106 is separated from the target 301 by a distance. If optical sensing elements are placed on the tool head 106, the distance can allow the debris and other by-products of laser drilling to contaminate the path of the laser beam due to, for example, absorption. This contamination can affect spectroscopy or luminosity reading.

Figure 4:
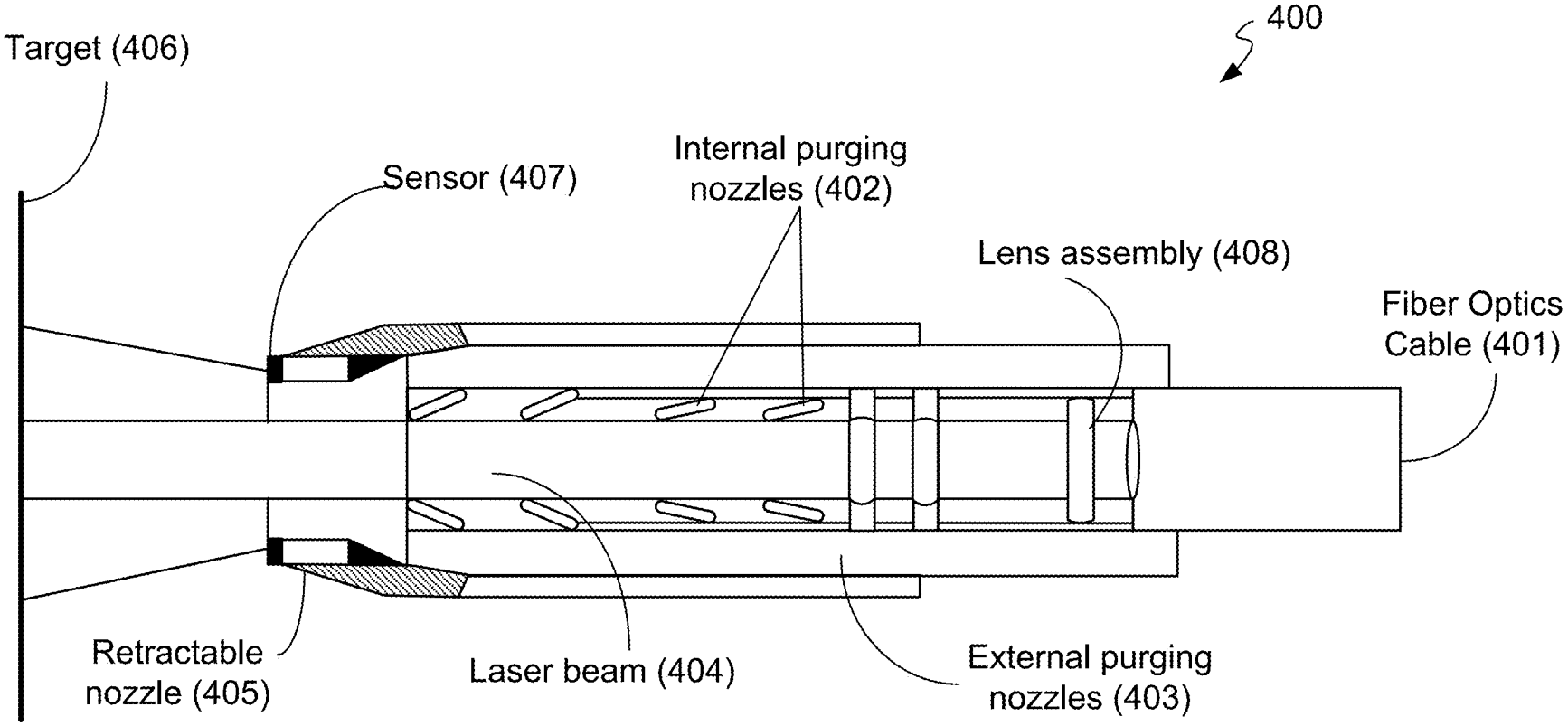
FIG. 4 is a diagram illustrating a configuration of a laser drilling tool with a retractable nozzle according to an implementation of the present disclosure.

FIG. 4 is a diagram 400 showing an example of a laser drilling tool assembly according to some implementations of the present disclosure. Diagram 400 illustrated a proposed solution to this problem that has plagued conventional systems. Specifically, the solution employs a design that includes one or more retractable nozzles. Here, the tool head includes fiber optic cable 401, internal purging nozzles 402, external purging nozzles 403, and retractable nozzles 405. Fiber optics cable 401 can provide laser beam 404 as the irradiation beam for the laser drilling operation. Internal purging nozzles 402 are configured to generate a flow of medium including water to merge with the laser beam 404 to the downhole target 406. External nozzles 403 are located on the outside of the lens assembly 408. External nozzles 403 can purge the hole/target area and clear a path for the laser beam 404. The purging can also result in cooling of the lens assembly 408. The retractable nozzle 405 is located at the tip of the tool. The retractable nozzle 405 can include sensing cable which is connected to sensor 407 mounted on the tip of the retractable nozzles. Sensor 407 can capture the reflected beam from the downhole target 406. Sensor 407 can additionally capture black body radiation from the downhole target 406. Sensor 407 can measure optical luminosity. For example, sensor 407 can include a charge-coupled device (CCD) sensor, a complementary metal oxide semiconductor (CMOS) sensor, an avalanche photodiode (APD), or a photo diode (PD). Sensor 407 can also include a spectral sensor, for example, a scanning sensor or a Fourier-transform infrared spectroscopy (FTIR) sensor. Additionally or alternatively, sensor 407 can include a coupling optical component, which is passive and which can capture light from the drilling process and then transmit the light to an optical sensor via the sensing cable 104. The tool head can additionally include additional sensors for measuring the ambient temperature and distance of the retractable nozzle from the downhole target. In these implementations, the retractable nozzle are extendable so that the distance between the target and fiber sensor that collect the light signals can be substantially minimized.

Figures 5A, 5B, 5C:
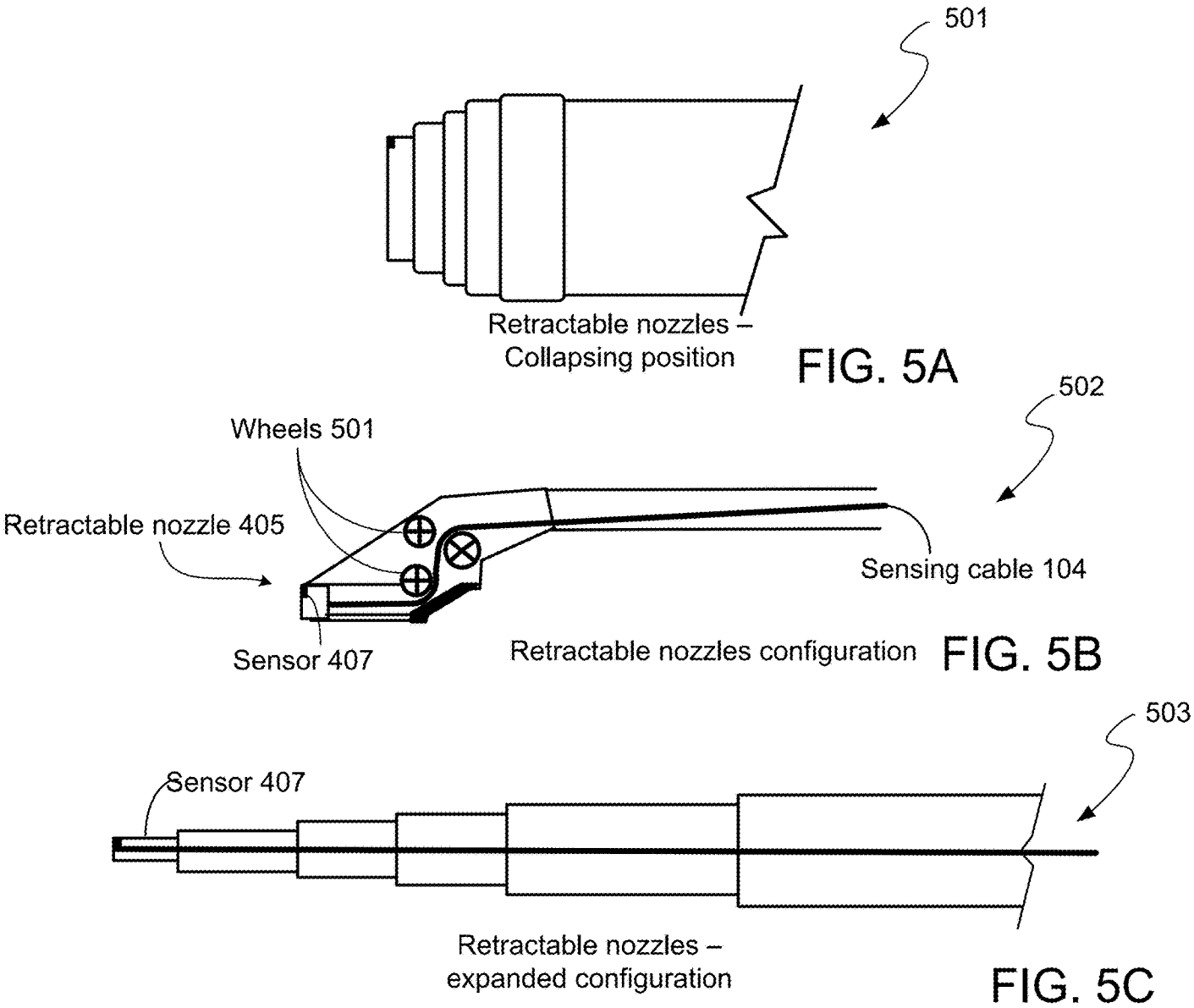
FIGS. 5A to 5C illustrate the retractable nozzle according to an implementation of the present disclosure.

FIGS. 5A to 5C illustrate the retractable nozzle according to an implementation of the present disclosure. In some implementations, the retractable nozzle is made of high thermal resistance materials. Examples of materials with high thermal resistance include: Silicon Carbide, Aluminum, copper, and plastics made by 3D printers such as ABS (acrylonitrile butadiene styrene) and PET-G (polyethylene terephthalate glycol-modified).

FIG. 5A illustrates the retractable nozzle 405 in a collapsing position 501. This is the position for the retractable nozzle when the laser beam is not activated or when the tool assembly is not in acquisition mode for collecting light signals.

FIG. 5B shows an example of an internal configuration 502 of a retractable nozzle which includes sensing cable 104, wheels 501, and sensor 407. Sensing cable 104 may transmit the collected light signals to reach the segment in the main tool where such light signals may be analyzed for spectroscopy and luminosity. Wheels 501 can allow for retraction and extension of the retractable nozzle. Wheels 501 may also allow the sensing cable 104 to be attached to the nozzle and to move smoothly along with the retracting/extending nozzle. In some cases, these wheels 501 can spin when the tool expanded and collapse.

FIG. 5C shows an example of the retracting nozzle in extended mode 503 in which sensor 407 is brought closer to the downhole target. When the laser drilling tool assembly is in operation, the retractable nozzle is extended. In some cases, an additional sensor is mounted on the tip of the tool head 106 to measure temperature and distance range. These measurements can be judiciously used to prevent the nozzle from getting too close to the target and get damaged by, for example, excessive heat.

Figure 6:
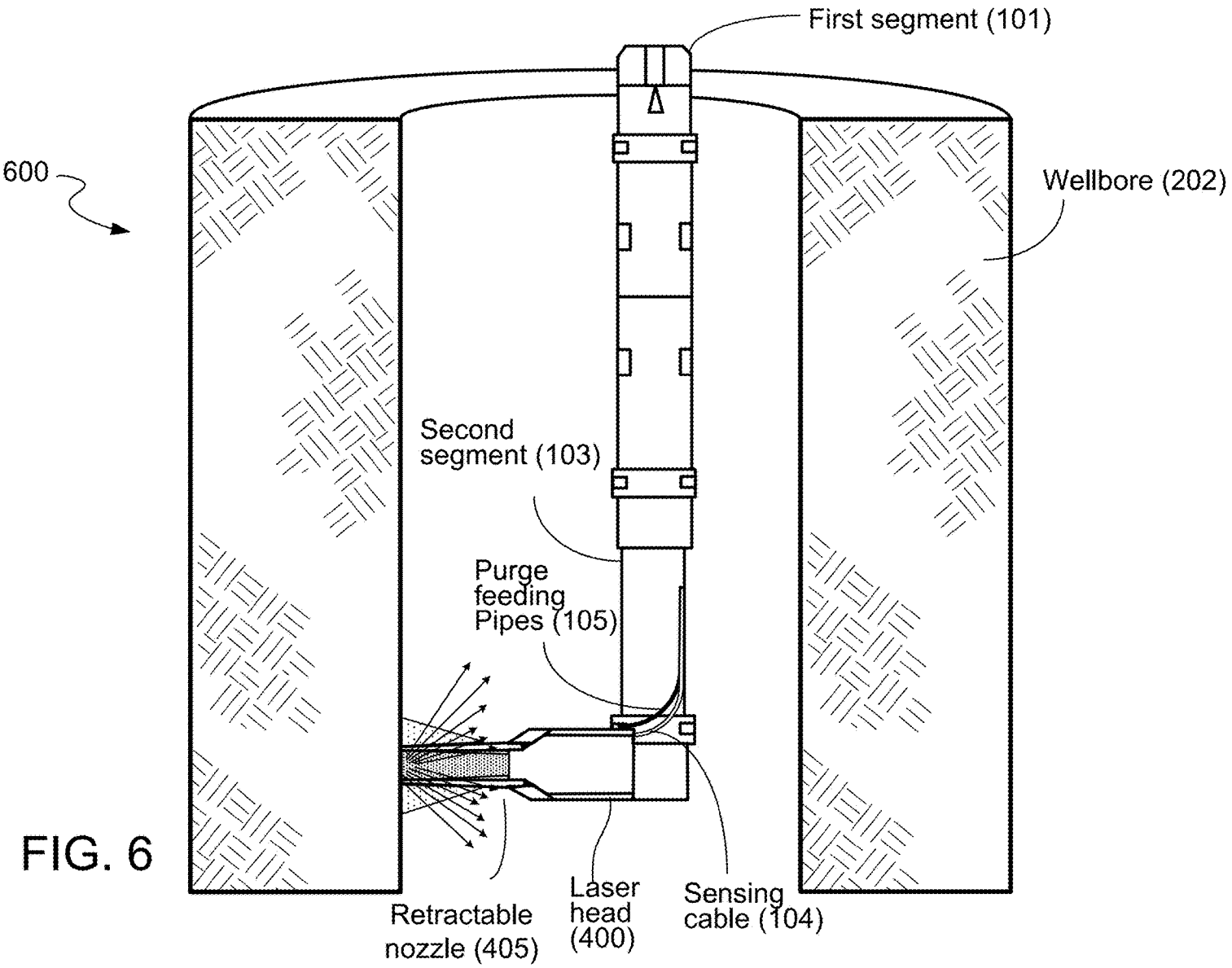
FIG. 6 is a diagram illustrating the laser drilling tool with the retractable nozzle in an extended position to collect reflected light according to an implementation of the present disclosure.

As illustrated in diagram 600 of FIG. 6, when the laser drilling tool assembly is in operational mode inside the shaft of a wellbore 202, the retractable nozzle is extended towards the downhole target. In this extended position, the distance between the tip of the retractable nozzle and the downhole target is shortened. This reduced distance can allow data acquisition to bypass the contamination caused by debris so that quality measurements of the reflected light can be obtained. The articulation of the retractable nozzles can be achieved by mechanical, electrical, and hydraulic or any other configurations. For example, FIG. 5B illustrates the use of wheels 501 to control the position of the retractable nozzles. The controlling of the retractable nozzle can be asserted from the surface or can be programmed by the tool assembly so that the tool assembly senses and determines the adequate amount of light being collected. As illustrated, the distance is close enough to capture the reflected light. At the same time, the tool is kept at a safe distance that prevents damage to the retractable nozzle. Some implementations may incorporate machine learning algorithms to iteratively adjust the extent of extending the retractable nozzle in view of measured temperature so that a judicious trade-off is achieved where contamination due to debris generation is substantially reduced while the tool head is not at the risk of damaging the sensor or optical sensing element by virtue of affinity to the impact zone. The measurement data collected can be transmitted to the surface wirelessly or stored on memory devices located on the laser drilling tool assembly. As explained, the measurement data includes data from a multipoint configuration. For example, the measurement data can include can include spectral data and luminosity data based on reflected light or black body radiation from downhole target. The measurement data can also include measurements of ambient temperature and distance between the tip of the retractable nozzle and the downhole target.

Figure 7:
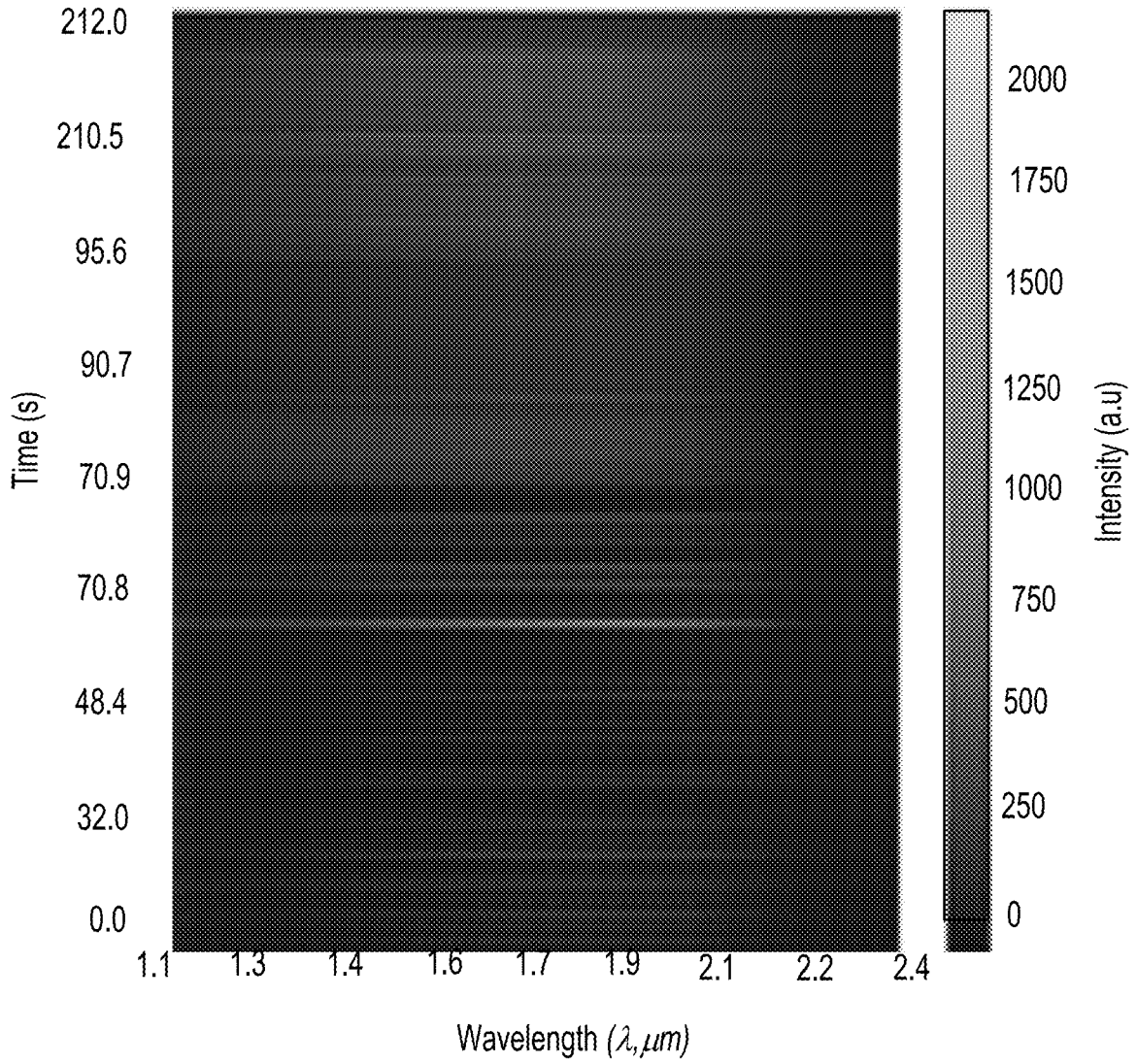
FIG. 7 shows examples of real-time and in-situ reflectance data collected by the laser drilling tool during the expanded operation according to an implementation of the present disclosure.

FIG. 7 shows an example of real-time and in-situ reflectance data as collected by a laser drilling tool assembly with a retractable nozzle. The acquired data is processed by an in-line spectrometer to provide a readout of the optical signals as a function of time (vertical axis) and wavelength (horizontal axis).

Figure 8:
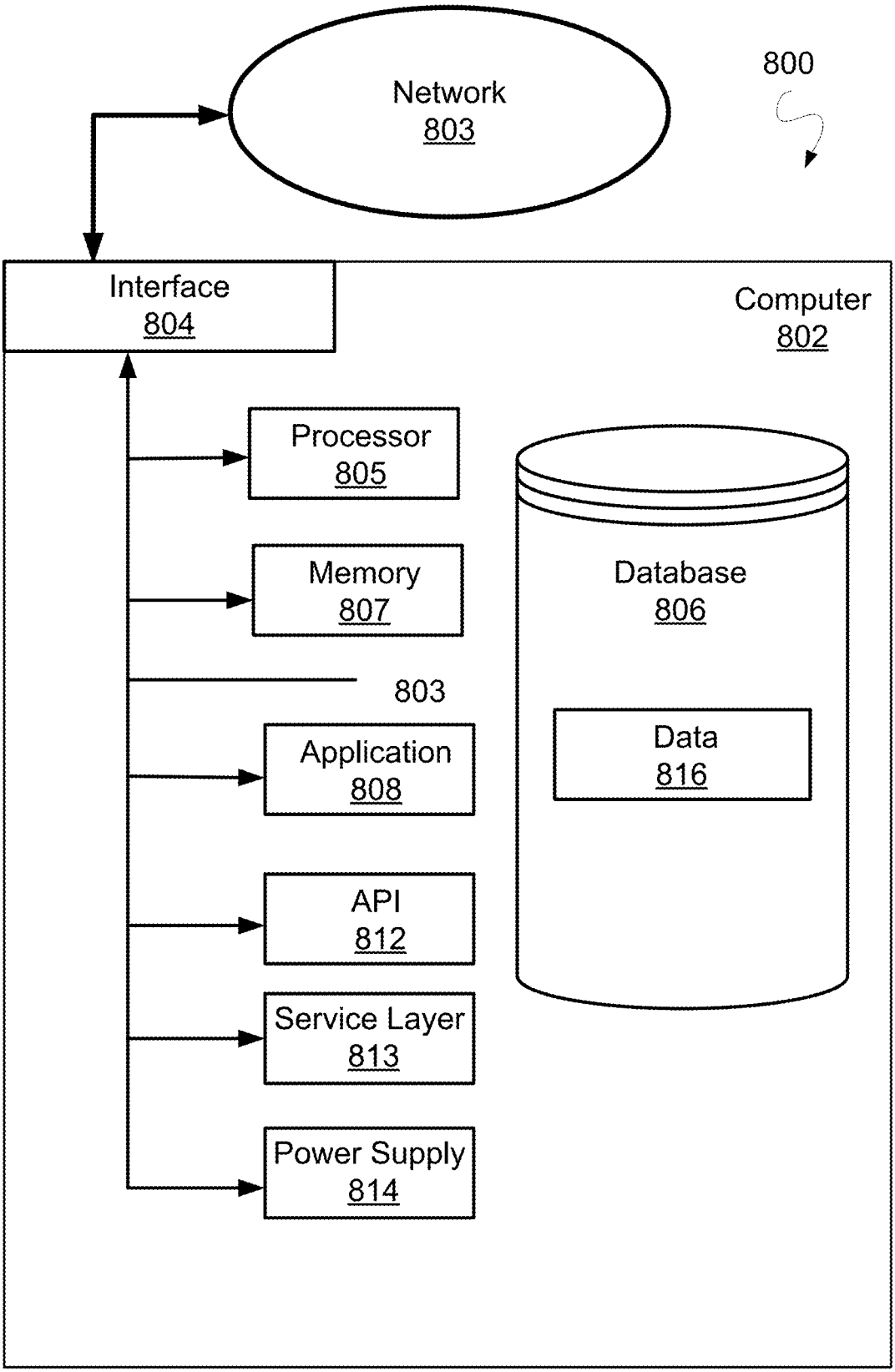
FIG. 8 is a block diagram illustrating an example of a computer system used to provide computational functionalities associated with described algorithms, methods, functions, processes, flows, and procedures, according to an implementation of the present disclosure.

FIG. 8 is a block diagram illustrating an example of a computer system 800 used to provide computational functionalities associated with described algorithms, methods, functions, processes, flows, and procedures, according to an implementation of the present disclosure. The illustrated computer 802 is intended to encompass any computing device such as a server, desktop computer, laptop/notebook computer, wireless data port, smart phone, personal data assistant (PDA), tablet computing device, one or more processors within these devices, another computing device, or a combination of computing devices, including physical or virtual instances of the computing device, or a combination of physical or virtual instances of the computing device. Additionally, the computer 802 can comprise a computer that includes an input device, such as a keypad, keyboard, touch screen, another input device, or a combination of input devices that can accept user information, and an output device that conveys information associated with the operation of the computer 802, including digital data, visual, audio, another type of information, or a combination of types of information, on a graphical-type user interface (UI) (or GUI) or other UI.

The computer 802 can serve in a role in a computer system as a client, network component, a server, a database or another persistency, another role, or a combination of roles for performing the subject matter described in the present disclosure. The illustrated computer 802 is communicably coupled with a network 803. In some implementations, one or more components of the computer 802 can be configured to operate within an environment, including cloud-computing-based, local, global, another environment, or a combination of environments.

The computer 802 is an electronic computing device operable to receive, transmit, process, store, or manage data and information associated with the described subject matter. According to some implementations, the computer 802 can also include or be communicably coupled with a server, including an application server, e-mail server, web server, caching server, streaming data server, another server, or a combination of servers.

The computer 802 can receive requests over network 803 (for example, from a client software application executing on another computer 802) and respond to the received requests by processing the received requests using a software application or a combination of software applications. In addition, requests can also be sent to the computer 802 from internal users, external or third-parties, or other entities, individuals, systems, or computers.

Each of the components of the computer 802 can communicate using a system bus 803. In some implementations, any or all of the components of the computer 802, including hardware, software, or a combination of hardware and software, can interface over the system bus 803 using an application programming interface (API) 812, a service layer 813, or a combination of the API 812 and service layer 813. The API 812 can include specifications for routines, data structures, and object classes. The API 812 can be either computer-language independent or dependent and refer to a complete interface, a single function, or even a set of APIs. The service layer 813 provides software services to the computer 802 or other components (whether illustrated or not) that are communicably coupled to the computer 802. The functionality of the computer 802 can be accessible for all service consumers using this service layer. Software services, such as those provided by the service layer 813, provide reusable, defined functionalities through a defined interface. For example, the interface can be software written in JAVA, C++, another computing language, or a combination of computing languages providing data in extensible markup language (XML) format, another format, or a combination of formats. While illustrated as an integrated component of the computer 802, alternative implementations can illustrate the API 812 or the service layer 813 as stand-alone components in relation to other components of the computer 802 or other components (whether illustrated or not) that are communicably coupled to the computer 802. Moreover, any or all parts of the API 812 or the service layer 813 can be implemented as a child or a sub-module of another software module, enterprise application, or hardware module without departing from the scope of the present disclosure.

The computer 802 includes an interface 804. Although illustrated as a single interface 804 in FIG. 8, two or more interfaces 804 can be used according to particular needs, desires, or particular implementations of the computer 802. The interface 804 is used by the computer 802 for communicating with another computing system (whether illustrated or not) that is communicatively linked to the network 803 in a distributed environment. Generally, the interface 804 is operable to communicate with the network 803 and comprises logic encoded in software, hardware, or a combination of software and hardware. More specifically, the interface 804 can comprise software supporting one or more communication protocols associated with communications such that the network 803 or interface's hardware is operable to communicate physical signals within and outside of the illustrated computer 802.

The computer 802 includes a processor 805. Although illustrated as a single processor 805 in FIG. 8, two or more processors can be used according to particular needs, desires, or particular implementations of the computer 802. Generally, the processor 805 executes instructions and manipulates data to perform the operations of the computer 802 and any algorithms, methods, functions, processes, flows, and procedures as described in the present disclosure.

The computer 802 also includes a database 806 that can hold data for the computer 802, another component communicatively linked to the network 803 (whether illustrated or not), or a combination of the computer 802 and another component. For example, database 806 can be an in-memory, conventional, or another type of database storing data consistent with the present disclosure. In some implementations, database 806 can be a combination of two or more different database types (for example, a hybrid in-memory and conventional database) according to particular needs, desires, or particular implementations of the computer 802 and the described functionality. Although illustrated as a single database 806 in FIG. 8, two or more databases of similar or differing types can be used according to particular needs, desires, or particular implementations of the computer 802 and the described functionality. While database 806 is illustrated as an integral component of the computer 802, in alternative implementations, database 806 can be external to the computer 802. As illustrated, the database 806 holds the previously described data 816 including, for example, multiple streams of data from various sources, such as the measurement data from the multi-point configuration as discussed in association with FIG. 6. Measurements from the multi-point configuration can include luminosity measurements, spectrum measurements, measurements of ambient temperature, and measurements of distance between the tip of the retractable nozzle and the downhole target.

The computer 802 also includes a memory 807 that can hold data for the computer 802, another component or components communicatively linked to the network 803 (whether illustrated or not), or a combination of the computer 802 and another component. Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 or similar or differing types can be used according to particular needs, desires, or particular implementations of the computer 802 and the described functionality. While memory 807 is illustrated as an integral component of the computer 802, in alternative implementations, memory 807 can be external to the computer 802.

The application 808 is an algorithmic software engine providing functionality according to particular needs, desires, or particular implementations of the computer 802, particularly with respect to functionality described in the present disclosure. For example, application 808 can serve as one or more components, modules, or applications. Further, although illustrated as a single application 808, the application 808 can be implemented as multiple applications 808 on the computer 802. In addition, although illustrated as integral to the computer 802, in alternative implementations, the application 808 can be external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion or management circuits (including recharging, standby, or another power management functionality). In some implementations, the power-supply 814 can include a power plug to allow the computer 802 to be plugged into a wall socket or another power source to, for example, power the computer 802 or recharge a rechargeable battery.

There can be any number of computers 802 associated with, or external to, a computer system containing computer 802, each computer 802 communicating over network 803. Further, the term "client," "user," or other appropriate terminology can be used interchangeably, as appropriate, without departing from the scope of the present disclosure. Moreover, the present disclosure contemplates that many users can use one computer 802, or that one user can use multiple computers 802.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to a receiver apparatus for execution by a data processing apparatus. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time," "real-time," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with an operating system of some type, for example LINUX, UNIX, WINDOWS, MAC OS, ANDROID, IOS, another operating system, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and apparatus can also be implemented as, special purpose logic circuitry, for example, a CPU, an FPGA, or an ASIC.

Computers for the execution of a computer program can be based on general or special purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of media and memory devices, magnetic devices, magneto optical disks, and optical memory device. Memory devices include semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Magnetic devices include, for example, tape, cartridges, cassettes, internal/removable disks. Optical memory devices include, for example, digital video disc (DVD), CD-ROM, DVD+/−R, DVD-RAM, DVD-ROM, HD-DVD, and BLURAY, and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity, a multi-touch screen using capacitive or electric sensing, or another type of touchscreen. Other types of devices can be used to interact with the user. For example, feedback provided to the user can be any form of sensory feedback. Input from the user can be received in any form, including acoustic, speech, or tactile input. In addition, a computer can interact with the user by sending documents to and receiving documents from a client computing device that is used by the user.

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the present disclosure), all or a portion of the Internet, another communication network, or a combination of communication networks. The communication network can communicate with, for example, Internet Protocol (IP) packets, Frame Relay frames, Asynchronous Transfer Mode (ATM) cells, voice, video, data, or other information between networks addresses.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what can be claimed, but rather as descriptions of features that can be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A laser drilling tool assembly, comprising:

a body that includes:

a first segment configured to receive an input beam from a laser source and couple the input beam to provide an irradiation beam to irradiate a downhole target, and a second segment housing one or more purging pipes; and a tool head that includes:

a retractable nozzle; and one or more optical sensing elements mounted on the retractable nozzle, wherein when the downhole target is being irradiated by the irradiation beam, the retractable nozzle is extended towards the downhole target such that the one or more optical sensing elements are positioned closer to the downhole target, wherein the one or more optical sensing elements include an optical luminosity sensor, or a spectral sensor.

2. The laser drilling tool assembly of claim 1, wherein the optical luminosity sensor comprises at least one of: a charge-coupled device (CCD) sensor, a complementary metal oxide semiconductor (CMOS) sensor, an avalanche photodiode (APD), or a photo diode (PD).

3. The laser drilling tool assembly of claim 1, wherein the spectral sensor comprises at least one of: a scanning sensor, or a Fourier-transform infrared spectroscopy (FTIR) sensor.

4. The laser drilling tool assembly of claim 1, wherein one or more optical sensing element include: coupling optical components configured to capture light signals emitted from the downhole target.

5. The laser drilling tool assembly of claim 4, wherein the tool head further comprises a sensing cable, wherein the light signals are transmitted, via the sensing cable, to an optical sensor that includes at least one of an optical luminosity sensor, or a spectral sensor, and wherein the optical sensor is located outside the tool head, and wherein the optical sensor is different from the at least one optical sensing elements mounted on the retractable nozzle of the tool head.

6. The laser drilling tool assembly of claim 5, wherein the tool head further comprises wheels in the retractable nozzle, wherein the wheels are configured to retract or extend the retractable nozzle, and wherein the wheels are further configured to attach the sensing cable to the retractable nozzle.

7. The laser drilling tool assembly of claim 1, wherein the tool head further comprises a sensor located at a tip of the tool head, wherein the sensor is configured to measure an ambient temperature and a range between the tip of the tool head and the downhole target when the downhole target is being irradiated by the irradiation beam.

8. The laser drilling tool assembly of claim 1, wherein the tool head further comprises:

a lens assembly to couple the irradiation beam to reach the downhole target.

9. The laser drilling tool assembly of claim 8, wherein the tool head further comprises:

one or more internal purging nozzles mounted inside the lens assembly and configured to spray a flow of medium to merge with the irradiation beam.

10. The laser drilling tool assembly of claim 8, wherein the tool head further comprises:

one or more external purging nozzles mounted outside the lens assembly and configured to purge debris from the downhole target being irradiated by the irradiation beam.

11. A method, comprising:

lowering an laser drilling tool assembly into a wellbore shaft in which a downhole target is located;

activating an irradiation beam that exits from a tool head of the laser drilling tool assembly;

extending one or more retractable nozzles on the tool head of the laser drilling tool assembly such that an optical sensing element mounted on the tool head is brought closer to the downhole target when the downhole target is being irradiated by the irradiation beam; and collecting light signals emitting from the downhole target being irradiated by the irradiating beam.

12. The method of claim 11, further comprising:

analyzing the light signals to characterize a rock type at the downhole target.

13. The method of claim 11, further comprising:

retracting the one or more retractable nozzles when the light signals have been collected.

14. The method of claim 11, further comprising:

measuring an ambient temperature and a range between a tip of the tool head and the downhole target when the downhole target is being irradiated by the irradiation beam.

15. The method of claim 14, further comprising:

in response to the ambient temperature exceeding a first threshold, or the range falling below a second threshold, halting an extension of the one or more retractable nozzles.

16. The method of claim 15, further comprising:

deactivating the irradiating beam.

17. The method of claim 11, further comprising:

activating one or more internal purging nozzles mounted inside a lens assembly of the tool head to spray a flow of medium to merge with the irradiation beam.

18. The method of claim 11, further comprising:

activating one or more external purging nozzles mounted outside a lens assembly of the tool head to purge debris from the downhole target being irradiated by the irradiation beam.

* * * * *